US009228368B2

(12) United States Patent
Barnett

(10) Patent No.: US 9,228,368 B2
(45) Date of Patent: Jan. 5, 2016

(54) ANTI-LIMB ENTRAPMENT INSERT

(71) Applicant: Ralph L. Barnett, Wilmette, IL (US)

(72) Inventor: Ralph L. Barnett, Wilmette, IL (US)

(73) Assignee: Triodyne Safety Systems, L.L.C., Northbrook, IL (US)

( * ) Notice: Subject to any disclaimer, the term of this patent is extended or adjusted under 35 U.S.C. 154(b) by 505 days.

(21) Appl. No.: 13/665,573

(22) Filed: Oct. 31, 2012

(65) Prior Publication Data

US 2013/0117924 A1 May 16, 2013

Related U.S. Application Data

(60) Provisional application No. 61/553,351, filed on Oct. 31, 2011.

(51) Int. Cl.
*E04H 4/14* (2006.01)
*E04H 4/12* (2006.01)

(52) U.S. Cl.
CPC ... *E04H 4/14* (2013.01); *E04H 4/12* (2013.01)

(58) Field of Classification Search
CPC ..... E04H 4/06; E04H 4/1236; E04H 4/1272; A61H 33/6073; Y10S 4/14
USPC ..... 4/504
See application file for complete search history.

(56) References Cited

U.S. PATENT DOCUMENTS

| | | | | |
|---|---|---|---|---|
| 1,792,345 | A * | 2/1931 | Williams | 210/164 |
| 3,239,149 | A | 3/1966 | Lindberg, Jr. | |
| 3,497,878 | A | 3/1970 | Emery | |
| 3,523,552 | A | 8/1970 | Ogden | |
| 3,616,916 | A | 11/1971 | Greene | |
| 3,620,372 | A | 11/1971 | Gordon | |
| 4,485,011 | A | 11/1984 | Cole et al. | |
| 4,490,067 | A | 12/1984 | Dahowski | |
| 4,742,593 | A | 5/1988 | Kallenbach | |
| 4,912,782 | A | 4/1990 | Robbins | |
| 4,973,403 | A | 11/1990 | Kozey | |
| 5,040,250 | A | 8/1991 | Barnes et al. | |
| D333,342 | S * | 2/1993 | Newhard | D23/261 |
| 5,341,523 | A | 8/1994 | Barnes | |
| 5,454,940 | A | 10/1995 | Lakotish | |
| 5,536,397 | A | 7/1996 | D'Offay | |

(Continued)

FOREIGN PATENT DOCUMENTS

| | | |
|---|---|---|
| DE | 3106822 A1 | 10/1982 |
| EP | 0677622 | 10/1995 |
| GB | 2297110 | 7/1996 |

OTHER PUBLICATIONS

"American National Standard for Suction Entrapment Avoidance in Swimming Pools, Wading Pools, Spas, Hot Tubs, and Catch Basins", ANSI/APSP-7, 2006.

"Guidelines for Entrapment Hazards: Making Pools and Spas Safer", U.S. Consumer Product Safety Commission, Mar. 2005, Washington, D.C.

(Continued)

*Primary Examiner* — Tuan N Nguyen
*Assistant Examiner* — William R Klotz
(74) *Attorney, Agent, or Firm* — Pauley Erikson & Kottis

(57) ABSTRACT

Missing covers on pipes of a pool circulation system can create a hair and limb entrapment hazard for swimmers. The present invention provides pipe insert with a cylindrical body having a plurality of fins that extend into the cylindrical body to prevent the entrapment of limbs in the pipes of the pool circulation system. The fins further comprise a geometry that easily sheds hair strands to prevent hair from getting trapped in the pipe.

11 Claims, 7 Drawing Sheets

(56) References Cited

U.S. PATENT DOCUMENTS

| | | | | | |
|---|---|---|---|---|---|
| 5,665,248 | A | | 9/1997 | McKiddy, II | |
| 5,734,999 | A | | 4/1998 | Nicholas | |
| 5,771,941 | A | | 6/1998 | Almeida | |
| 5,799,339 | A | * | 9/1998 | Perry et al. | 4/286 |
| 5,809,587 | A | | 9/1998 | Fleischer | |
| 5,894,609 | A | | 4/1999 | Barnett | |
| D410,073 | S | | 5/1999 | Barnett | |
| 5,978,981 | A | * | 11/1999 | Nelson | 4/541.1 |
| 6,009,573 | A | | 1/2000 | Thibault | |
| D421,101 | S | | 2/2000 | Barnett | |
| D421,102 | S | | 2/2000 | Barnett | |
| D421,295 | S | * | 2/2000 | Barnett | D23/261 |
| 6,088,842 | A | * | 7/2000 | Barnett | 4/286 |
| 6,170,095 | B1 | | 1/2001 | Zars | |
| D439,957 | S | | 4/2001 | Barnett et al. | |
| 6,230,337 | B1 | * | 5/2001 | Barnett | 4/507 |
| 6,295,661 | B1 | | 10/2001 | Bromley | |
| 6,393,631 | B2 | * | 5/2002 | Schroader | 4/504 |
| 6,561,391 | B1 | | 5/2003 | Baker | |
| 6,578,208 | B1 | | 6/2003 | Lytle | |
| 6,615,417 | B1 | * | 9/2003 | Newhard | 4/507 |
| 6,738,994 | B2 | * | 5/2004 | Barnett et al. | 4/507 |
| 6,760,931 | B1 | * | 7/2004 | Mattson et al. | 4/541.1 |
| D550,819 | S | * | 9/2007 | Seehoff | D23/261 |
| D563,529 | S | * | 3/2008 | Labonte | D23/261 |
| D669,969 | S | * | 10/2012 | Forrest et al. | D23/261 |
| 8,409,433 | B2 | * | 4/2013 | Worth et al. | 210/163 |
| D715,892 | S | * | 10/2014 | Zhang et al. | D22/122 |
| 2012/0047643 | A1 | * | 3/2012 | Meyers | 4/292 |
| 2013/0125302 | A1 | * | 5/2013 | Barnett | 4/504 |

OTHER PUBLICATIONS

Velasco, Maria Valeria Robles et al., "Hair Fiber Characteristics and Methods to evaluate Hair Physical and Mechanical Properties", Brazilian Jnl of Pharmaceutical Sciences, v. 45, No. 1, pp. 153-162, Jan.-Mar. 2009.

"Unexpected Properties of Hair", LorealHairScience.com, http://www.hair-science.com/__int/__en/topic/topic__sousrub.aspx?tc=root-hair-scienceso-sturdy-so-fragileproperties-of-hair&cur=properties-of-hair.

"Hair Strength", www.keratin.com, http://www.keratin.com/aa/aa016.shtml.

"American National Standard for Suction Fittings for Use in Swimming Pools, Wading Pools, Spas and Hot Tubs", ANSI/APSP-16, 2011.

Barnett, Ralph L., "Anti-Hair Entanglement", Triodyne Inc. Safety Alert, vol. 1, No. 1, Feb. 1998.

Barnett, Ralph L. et al., "Anti-Hair Snare Pool Drain Cover", Triodyne Inc. Safety Brief, vol. 18, No. 4, May 2001.

New York Codes, Rules and Regulations, 6-1.29, Section 9.6.2, Swimming Pool Design Standards, 2007.

Virginia Graeme Baker Pool and Spa Safety Act, 15 U.S.C. 8001.

"Suction Fittings for Use in Swimming Pools, Wading Pools, Spas and Hot Tubs", ASME A112.19-8-2007, 2007.

"Code of Practice for Swimming Pools: Metric Units", New Zealand Standards, NZS 4441: 1985.

Woodruff, John, "Improving the Strength of Hair", Cosmetics and Toiletries Magazine, 2002.

"VGB Series Submerged, Multiple and Single Suction Outlet Instructions", AquaStar, Rev. 031813, www.aquastarpoolproducts.com.

* cited by examiner

ANTI-LIMB ENTRAPMENT INSERT

CROSS REFERENCE TO RELATED APPLICATION

This application claims the benefit of U.S. Provisional Patent Application Ser. No. 61/553,351, filed on 31 Oct. 2011. The Provisional Patent Application is hereby incorporated by reference herein in its entirety and is made a part hereof, including but not limited to those portions which specifically appear hereinafter.

BACKGROUND OF THE INVENTION

This invention relates to drain constructions located in the bottom or along the sides of a pool or hot tub through which water flows under the action of gravity or a pump that acts to suck water out of the pool.

The dangers inherent in pools and hot tubs having circulating water systems are well known and documented. For example, suction or vacuum forces frequently occur near the water drains sufficient to hold a swimmer or user in life threatening situations. Entanglement or knotting of hair on or through a sump, suction line or a drain grate can also cause injuries and possibly drowning.

Limbs can be inserted into suction lines, such as PVC pipes, when the suction fittings or covers are removed or missing from a sump. Suction can draw the limbs into the pipes fitted to the sumps; here the limbs can be trapped by suction, friction, swelling of the limb, etc.

A homemade remedy for the limb entrapment hazard is to insert a couple of cross bolts in a simple pattern at the entrance to the pipe. Bathtub drains and slop sink drains adopt this concept. Some drain lines use manufactured perforated covers. These concepts generally introduce a hair entrapment hazard. They can also give rise to a mechanical finger entrapment hazard. Furthermore, they allow a hand to seal off a small pipe (2" to 3" diameter) and instantly develop close to the theoretical vacuum limit (14.7 psi). A three inch PVC pipe can develop nearly 100 lbs of holding force on a bather.

SUMMARY OF THE INVENTION

A general object of the invention is to provide an insert that can be inserted into a pipe of a pool water circulation system to prevent injuries that can be caused by limbs or hair getting trapped in the pipe. The general object of the invention can be attained, at least in part, through a plurality of fins extending inwards of the insert and protrusions extending from a top edge of the insert.

In a preferred embodiment, the insert includes a cylindrical body including an inner surface and an outer surface. The insert preferably further includes a plurality of fins mounted to the inner surface and extending inward of the cylindrical body. The fins are preferably sized to prevent limb insertion. The fins are also preferably shaped to shed hair thereby preventing trapping of a person by his or her hair. In one embodiment, the fins include an iso-friction curve that easily sheds hair strands.

In a preferred embodiment of this invention, the insert includes a plurality of protrusions that extend from the insert and outside of the pipe to provide a non-planar edge at an end of the pipe to prevent the formation of a vacuum seal with a body part. In an embodiment of this invention, the protrusion is formed as a part of the fin. In another embodiment of this invention, the protrusion is formed as a scalloped or castellated peripheral edge of the insert.

BRIEF DESCRIPTION OF THE DRAWINGS

These and other objects and features of this invention will be better understood from the following detailed description taken in conjunction with the drawings, wherein.

DETAILED DESCRIPTION OF PREFERRED EMBODIMENTS

The present invention provides an insert for a pipe of a pool circulation system. The insert prevents injuries that can be caused by hair or body parts getting trapped in the pipes.

Figure 1:
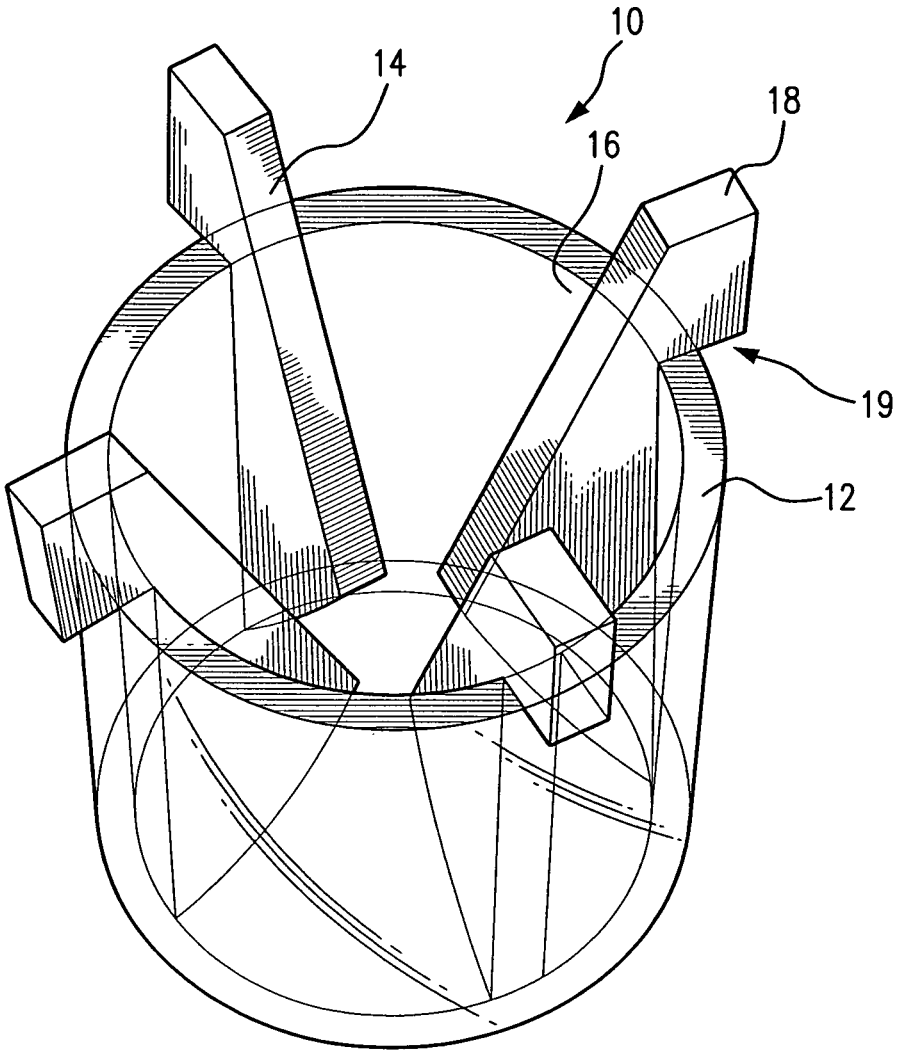
FIG. 1 is a perspective view of an anti-limb entrapment insert according to one embodiment of this invention.
Figure 2:
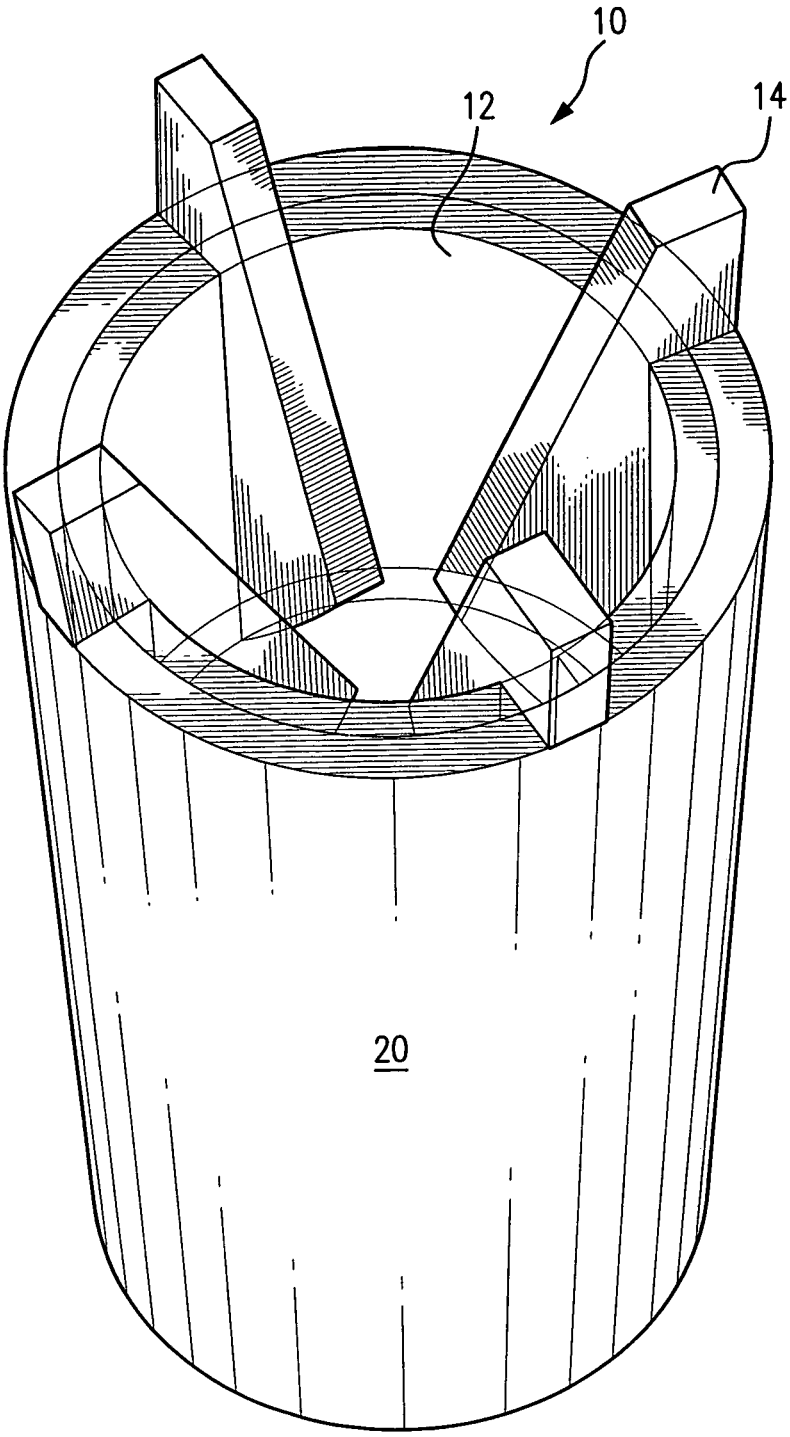
FIG. 2 is a perspective view of the anti-limb entrapment insert of FIG. 1 positioned within a pipe.

FIG. 1 shows an anti-limb entrapment insert 10 according to an embodiment of this invention. FIG. 2 shows the anti-limb entrapment insert 10 of FIG. 1 positioned within a pipe 20. Preferably, the anti-limb entrapment insert 10 is permanently adhered to the pipe 20 with an adhesive. Alternatively, the anti-limb entrapment insert 10 may be integrally formed with the pipe 20. In a preferred embodiment, the insert 10 can be retrofit to existing pipes that are flush to mounting walls or sump walls.

The anti-limb entrapment insert 10 of this invention preferably includes a cylindrical body 12 and a plurality of fins 14 extending in from an inner surface 16 of the cylindrical body 12. In this embodiment, the anti-limb entrapment insert 10 is manufactured from plexiglass, however, the anti-limb entrapment insert 10 need not be made from plexiglass and may be made from another material able to maintain sufficient strength to prevent limb insertion while exposed to chlorinated water including, but not limited to, PVC and metal materials.

The fins 14 are preferably designed and sized to prevent limb insertion into the pipe 20. In the embodiment of FIG. 1, the anti-limb entrapment insert 10 includes four fins 14 that extend towards a center of the cylindrical body 12. However, the anti-limb entrapment insert 10 may include any number of fins 14 and the fins 14 may extend inwards at an angle and away from the center of the cylindrical body 12.

Figure 3:
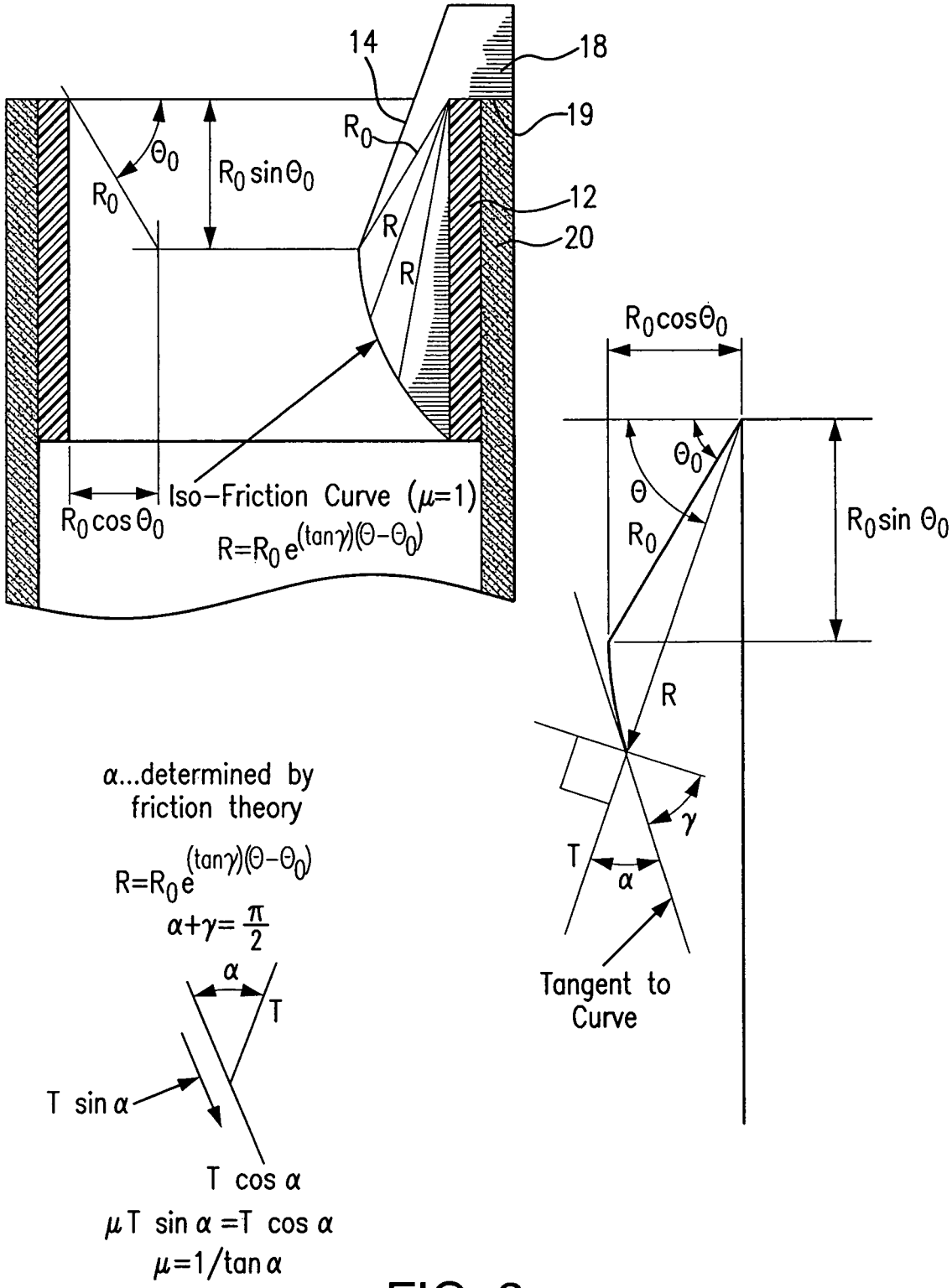
FIG. 3 is a cross-sectional view of the anti-limb entrapment insert of FIG. 1.

The fins 14 are preferably designed with a geometry that sheds hair preventing the entrapment of a swimmer by his or her hair. The fin geometry should also be designed to pass a "finger probe" test to prevent mechanical finger entrapment. The geometry may comprise, for example but not limited to, a smooth curve or a tapered surface. FIG. 3 shows a cross-sectional view of the anti-limb entrapment insert 10 according to one embodiment of this invention. In this embodiment, an upper half of the fin 14 comprises a tapered surface and a lower half of the fin 14 comprises an iso-friction curve ($\mu=1$) with a distance, R, at any point of the curve is defined by:

$$R=R_o e^{(\tan\gamma)(\theta-\theta_o)}$$

Where $R_o$ equals an initial distance of the curve at an initial angle, $\theta_o$, $\theta$ equals the angle of R, $\alpha$ equals the angle of R to a tangent to the curve of the fin at R, and $\gamma$ equals the compliment of the angle $\alpha$. However, it should be understood that the anti-limb entrapment insert 10 of this invention may not comprise the curve shown in FIG. 3 and may comprise any curve or other shape that does not allow hair to become entrapped or entangled in the pipe 20 of the pool circulation system.

In the embodiment of FIG. 1, the fins 14 further include a protrusion 18 that extend from the cylindrical body 12. When inserted in the pipe 20, the protrusion 18 provides a non-planar surface at an opening of the pipe 20. The protrusion 18 prevents the formation of a seal around the pipe 20 opening with a body part and thereby prevents the formation of a vacuum at the pipe 20 opening that could result in injury to a swimmer. In the embodiment of FIG. 1, the protrusion 18 also includes a catch 19 extending outside of the cylindrical body 12 to prevent the insert 10 from being inserted too far into the pipe 20. In an alternative embodiment, the protrusion 18 may be formed as a part of the cylindrical body 12. In another alternative embodiment, the anti-limb entrapment insert 10 may not include the protrusion 18.

Figure 4:
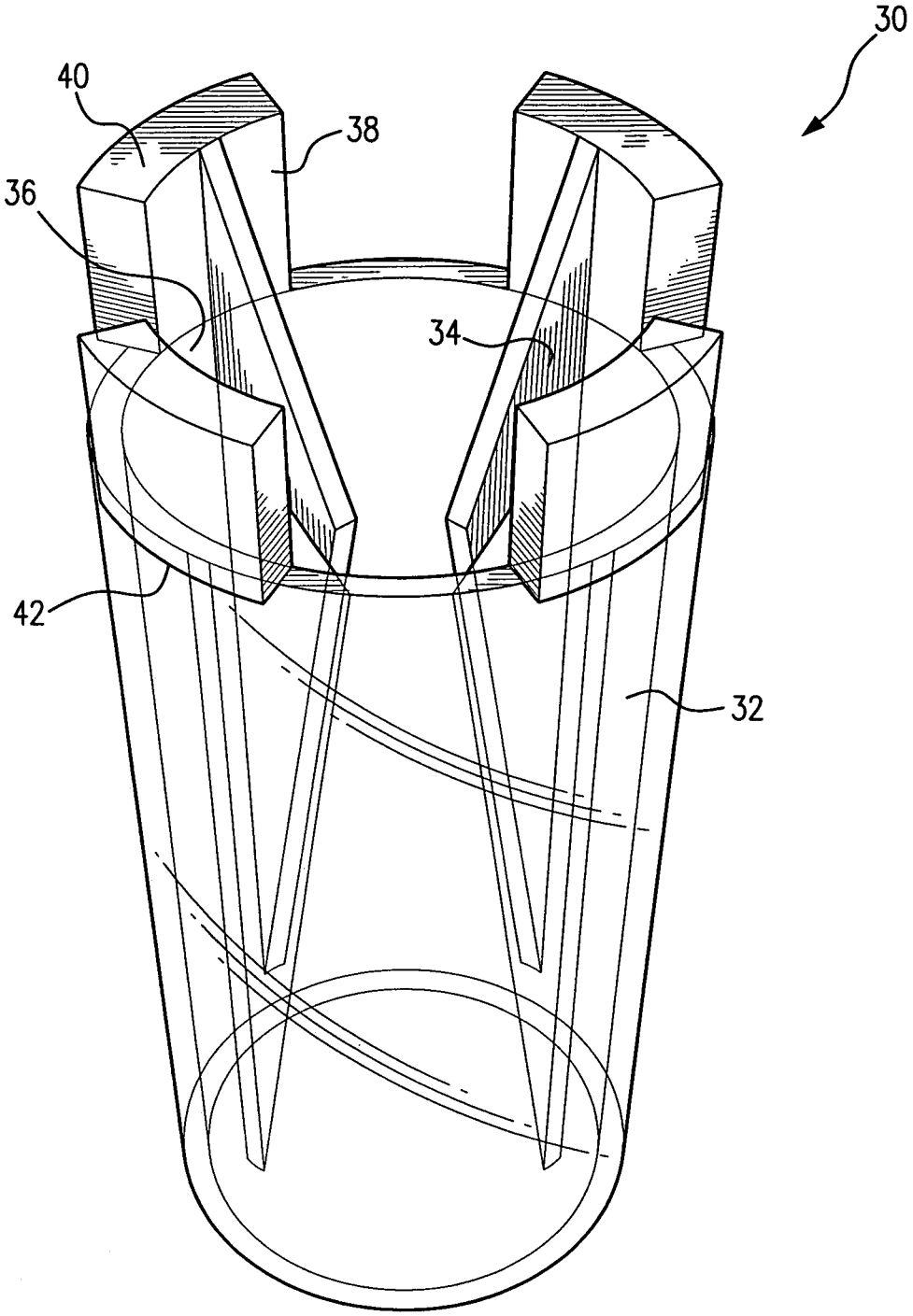
FIG. 4 is a perspective view of an anti-limb entrapment insert according to another embodiment of this invention.
Figure 5:
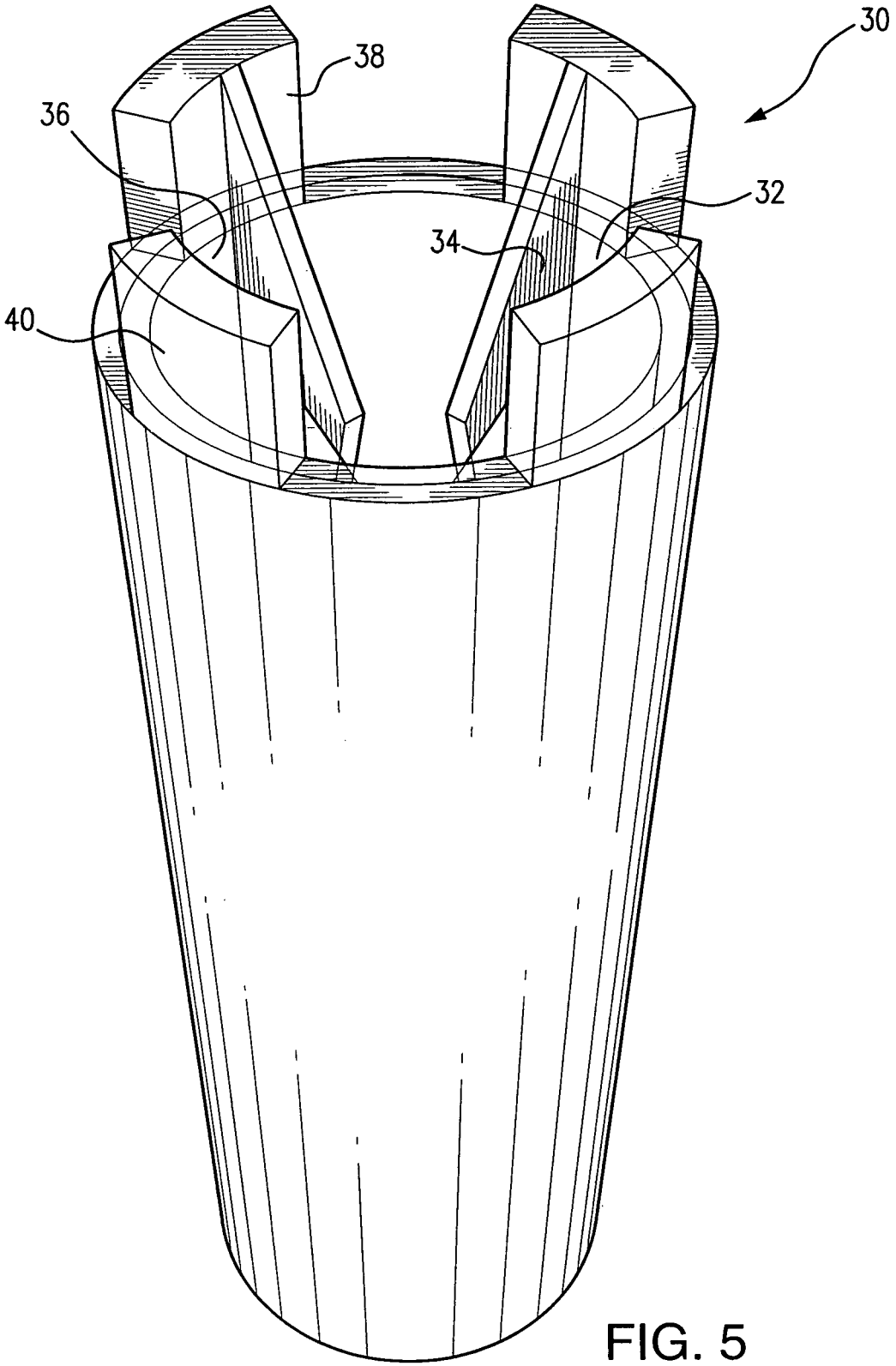
FIG. 5 is perspective view of the anti-limb entrapment insert of FIG. 4 positioned within a pipe.

FIG. 4 shows another embodiment of the anti-limb entrapment insert 30 of this invention. FIG. 5 shows the anti-limb entrapment insert 30 of FIG. 4 positioned within the pipe 20. The anti-limb entrapment insert 30 of this embodiment includes a cylindrical body 32 and a plurality of fins 34 extending in from an inner surface 36 of the cylindrical body 32. In this embodiment, the cylindrical body 32 is formed with a non-planar top edge 38 in a castellation pattern. However, the non-planar top edge 38 may comprise any non-planar shape including, but not limited to, a scalloped edge, a triangle wave pattern and a saw tooth edge. The non-planar top edge 38 prevents the formation of a seal around the pipe 20 opening thereby preventing the formation of a vacuum that could result in an injury, such as drowning or disembowelment. In a preferred embodiment, the difficulty in sealing the pipe 20 opening is enhanced by a plurality of bosses 40 mounted to a portion of the non-planar edge 38. In the embodiment of FIG. 4, each boss 40 is mounted to a merlon of the castellation pattern to increase the thickness and strength of the merlon. In an alternative embodiment, the bosses 40 may be integrally formed as a part of the cylindrical body 42. The boss 40 also provides a catch 42 to prevent the insert 30 from being inserted too far into the pipe 20.

In the embodiment of FIGS. 4 & 5, the anti-limb entrapment insert 30 includes four fins 34 that extend towards a center of the cylindrical body 32 to prevent limb insertion. Alternatively, the anti-limb entrapment insert 30 may be designed with any number of fins 34 that prevent the insertion and entrapment of limbs and fingers. The fins 34 are preferably designed with a geometry that sheds hair preventing the entrapment of a swimmer by his or her hair. In this embodiment, each of the fins 34 comprises a tapered top half and a tapered bottom half. However, it should be understood that the fins 34 may not comprise the shape described above and may comprise a curve or another shape that does not allow hair to become entrapped or entangled in the pipe 20.

Figure 6:
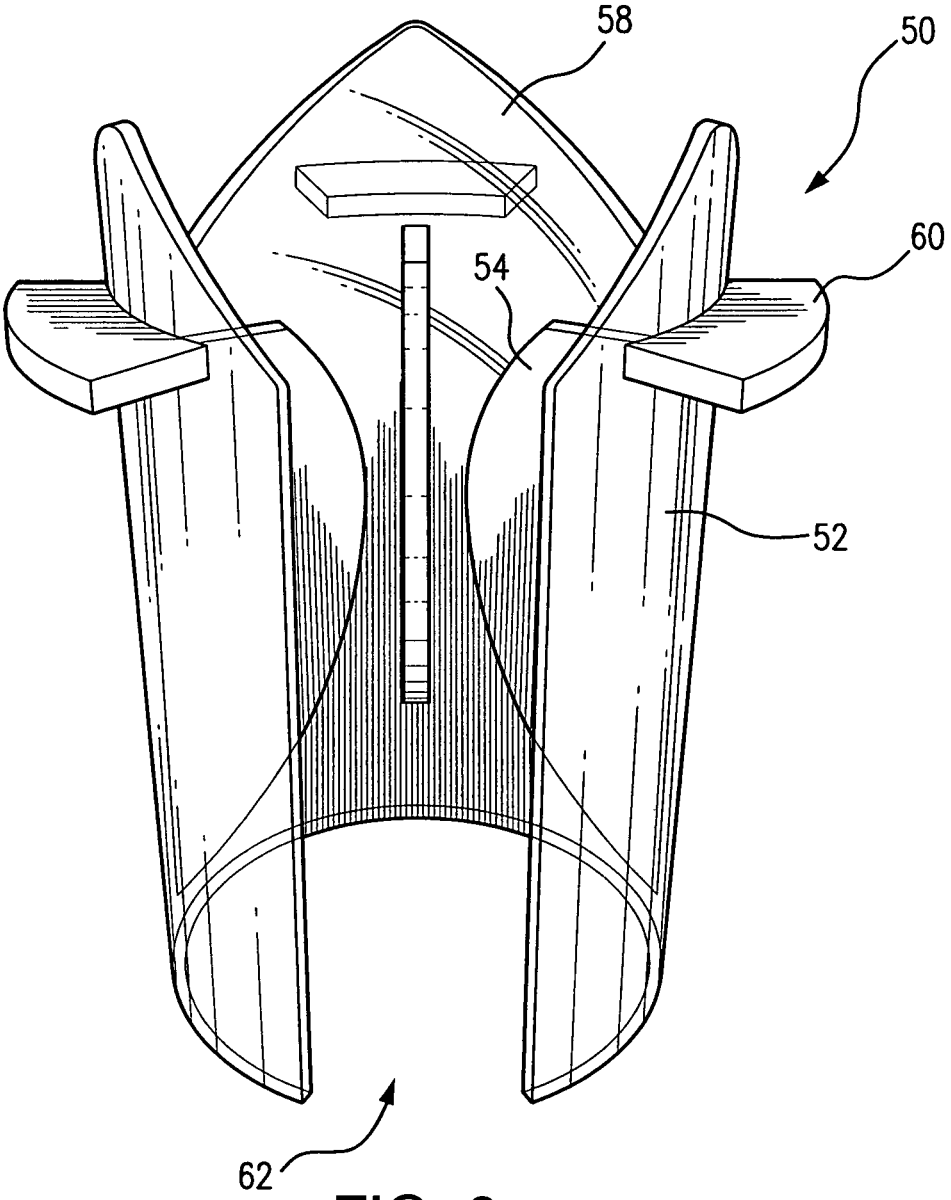
FIG. 6 is a perspective view of an anti-limb entrapment insert according to another embodiment of this invention.
Figure 7:
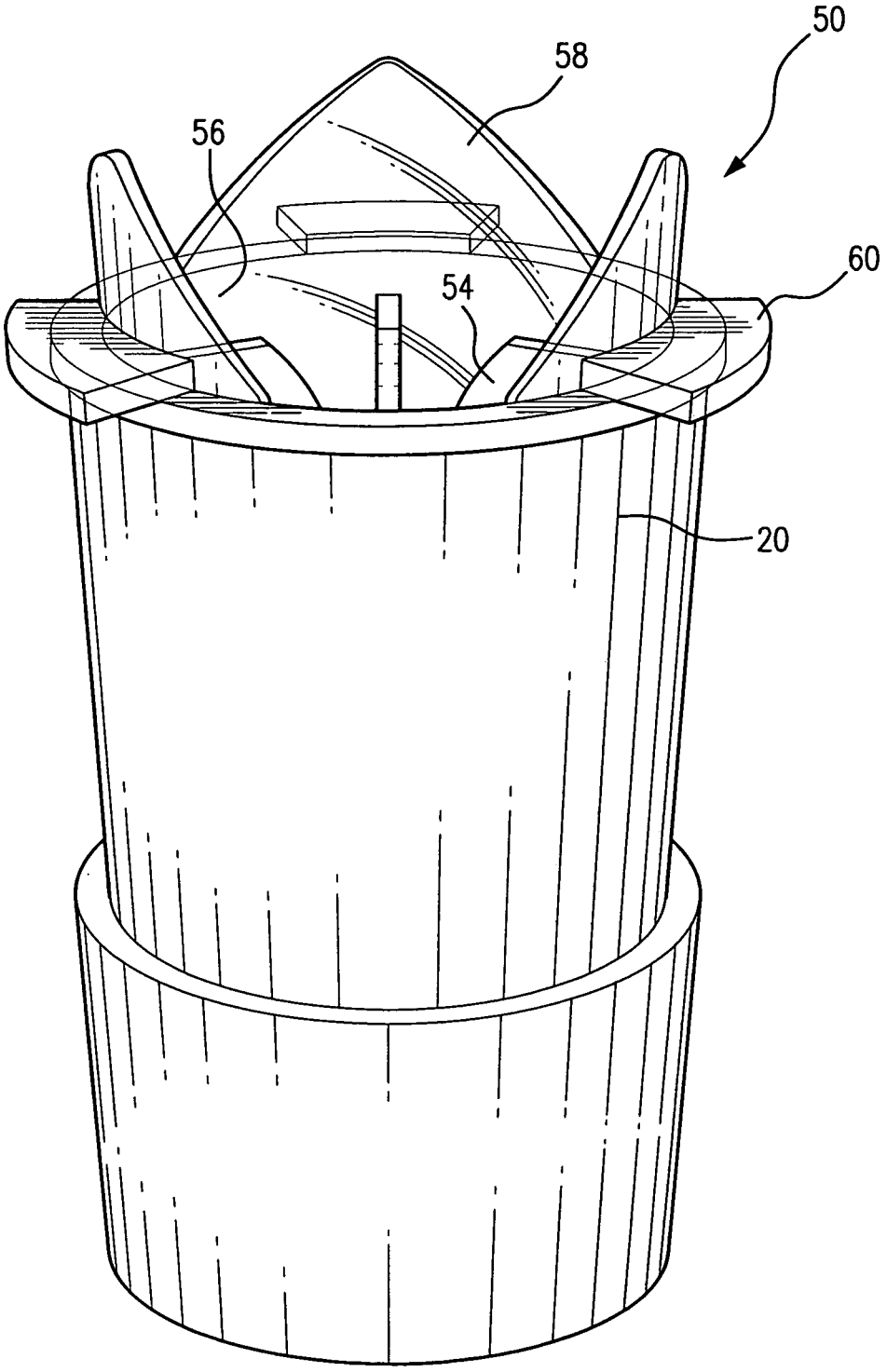
FIG. 7 is perspective view of the anti-limb entrapment insert of FIG. 6 positioned within a pipe.

FIG. 6 shows another embodiment of the anti-limb entrapment insert 50 of this invention. FIG. 7 shows the anti-limb entrapment insert 50 of FIG. 6 positioned within the pipe 20. The anti-limb entrapment insert 50 of this embodiment includes a cylindrical body 52 and a plurality of fins 54 extending in from an inner surface 56 of the cylindrical body 52. In this embodiment, the cylindrical body 52 includes a non-planar top edge 58 in a triangle wave pattern. However, the non-planar top edge 58 may comprise any non-planar shape including, but not limited to, a scalloped edge and a saw tooth edge. The non-planar top edge 58 prevents the formation of a seal around the pipe 20 opening thereby preventing the formation of a vacuum that could result in an injury.

In the embodiment of FIGS. 6 & 7, the anti-limb entrapment insert 50 includes three fins 54 that extend towards a center of the cylindrical body 52 to prevent limb insertion and entrapment. However, the anti-limb entrapment insert 50 may be designed with any number of fins 54 that prevent the insertion and entrapment of limbs and fingers. In this embodiment, the fins 54 include a geometry that sheds hair preventing the entrapment of a swimmer by his or her hair. Each of the fins 54 comprises a straight horizontal top section that extends from the inner surface 56 near the non-planar edge and transitions to a smooth arc that extends further towards the center of the cylindrical body 52 before curving back towards the inner surface 56 of the cylindrical body 52. However, it should be understood that the fins 54 need not comprise this geometry and may comprise any geometry does not allow hair to become entrapped or entangled in the pipe 20.

In the embodiment of FIGS. 6 & 7, the anti-limb entrapment insert 50 further include a plurality of tabs 60 extending from an outer surface of the cylindrical body 12. The tabs 60 comprise a horizontal projection that prevents the insert 50 from being inserted too far into the pipe 20.

In a preferred embodiment of this invention, the anti-limb entrapment insert 50 further includes a split 62. In the embodiment of FIG. 6, the split 62 comprises a vertical opening in the cylindrical body 52. The split 62 allows the insert 50 to be easily inserted into the pipe 20. Additionally, the split 62 allows the insert 50 to accommodate various diameter pipes 20 with a single design. In the embodiment of FIG. 6, the split 62 comprises approximately 15% of the circumference of the cylindrical body 52 however, the split 62 may be designed to comprise a larger or smaller section of the cylindrical body 52.

Thus, the present invention provides an insert that can be retrofit to a pipe of a pool water circulation system to prevent injuries that can be caused by limbs or hair getting trapped in the pipe.

While in the foregoing specification this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. An anti-limb entrapment insert for a pipe for a pool circulation system comprising:

a cylindrical body including an inner surface; and a fin mounted to the inner surface of the cylindrical body wherein the fin extends inside the cylindrical body, wherein the fin comprises a geometry that sheds hair strands, said fin geometry that sheds hair strands comprises an iso-friction curved segment, wherein the iso-friction curved segment has a distance, R, at any point of the curve defined by:

$$R=R_o e^{(\tan\gamma)(\theta-\theta_o)}$$

where $R_o$ equals an initial distance of the curve at an initial angle, $\theta_o$, $\theta$ equals the angle of R, $\alpha$ equals the angle of R to a tangent to the curve of the fin at R, and $\gamma$ equals the compliment of the angle $\alpha$.

2. The anti-limb entrapment insert of claim 1, further comprising:

a protrusion extending from at least one of the fin and the cylindrical body to provide a non-planar edge to the pipe.

3. The anti-limb entrapment insert of claim 2, further comprising:

a boss positioned on the protrusion.

4. The anti-limb entrapment insert of claim 1, wherein the cylindrical body includes a split.

5. The anti-limb entrapment insert of claim 1, wherein the fin comprises a top half and a bottom half, and the geometry of the top half includes a linear segment and the bottom half includes a curved segment.

6. The anti-limb entrapment insert of claim 1, wherein the cylindrical body includes a non-planar edge.

7. The anti-limb entrapment insert of claim 1, further comprising:

a catch connected to at least one of the cylindrical body and the fin.

8. An anti-limb entrapment insert for a pipe for a pool circulation system comprising:

a cylindrical body including an inner surface, an outer surface and a non-planar top edge;

a tab mounted on the outer surface; and a fin mounted to the inner surface of the cylindrical body wherein the fin extends inside the cylindrical body and includes a geometry that sheds hair strands, wherein said fin geometry that sheds hair strands comprises an iso-friction curved segment with a distance, R, at any point of the curve defined by:

$$R=R_o e^{(\tan\gamma)(\theta-\theta_o)}$$

where $R_o$ equals an initial distance of the curve at an initial angle, $\theta_o$, $\theta$ equals the angle of R, $\alpha$ equals the angle of R to a tangent to the curve of the fin at R, and $\gamma$ equals the compliment of the angle $\alpha$.

9. The anti-limb entrapment insert of claim 8, wherein the cylindrical body includes a split.

10. The anti-limb entrapment insert of claim 8, wherein the fin includes a tapered segment.

11. The anti-limb entrapment insert of claim 8, further comprising:

a boss positioned on a portion of the non-planar edge.

* * * * *